United States Patent [19]

Morris et al.

[11] Patent Number: 4,786,885

[45] Date of Patent: Nov. 22, 1988

[54] MOLDED CASE CIRCUIT BREAKER SHUNT TRIP UNIT

[75] Inventors: Robert A. Morris, Burlington; Paul T. Rajotte, Plainville; Alan J. Messerli, Bristol, all of Conn.

[73] Assignee: General Electric Company, New York, N.Y.

[21] Appl. No.: 133,867

[22] Filed: Dec. 16, 1987

[51] Int. Cl.[4] ..... H01H 9/02; H01H 13/04

[52] U.S. Cl. ..... 335/202; 200/309

[58] Field of Search ..... 335/172, 173, 174, 175, 335/6, 20, 202; 200/293, 303, 304, 309

[56] References Cited

U.S. PATENT DOCUMENTS

| | | | |
|---|---|---|---|
| 4,297,663 | 10/1981 | Seymour et al. | 335/20 |
| 4,589,052 | 5/1986 | Dougherty | 361/94 |
| 4,591,942 | 5/1986 | Willard et al. | 361/97 |
| 4,622,444 | 11/1986 | Kandatsu et al. | 200/303 |
| 4,679,019 | 7/1987 | Todaro et al. | 335/172 |
| 4,700,161 | 10/1987 | Todaro et al. | 335/172 |

*Primary Examiner*—E. A. Goldberg
*Assistant Examiner*—Lincoln Donovan
*Attorney, Agent, or Firm*—Richard A. Menelly; Walter C. Bernkopf; Fred Jacob

[57] ABSTRACT

An integrated protection unit is a circuit breaker which includes basic overcurrent protection facility along with selective electrical accessories. A molded plastic accessory access cover secured to the integrated protection unit cover protects the accessory components contained within the circuit breaker cover from the environment. A shunt trip unit is one such accessory component which can be field-installed without affecting the integrity of the circuit breaker overcurrent protection components.

15 Claims, 4 Drawing Sheets

MOLDED CASE CIRCUIT BREAKER SHUNT TRIP UNIT

BACKGROUND OF THE INVENTION

The trend in the circuit protection industry is currently toward complete circuit protection which is accomplished by the addition of supplemental protection apparatus to standard overcurrent protective devices, such as molded case circuit breakers. In the past, when such auxiliary protection apparatus or other circuit breaker accessories were combined with a standard circuit breaker, the accessories were usually custom-installed at the point of manufacture. The combined protective device, when later installed in the field, could not be externally accessed for inspection, replacement or repair without destroying the integrity of the circuit breaker interior. An example of one such factory installed circuit breaker accessory is found in U.S. Pat. No. 4,297,63 entitled "Circuit Breaker Accessories Packaged in a Standardized Molded Case", which patent is incorporated herein for reference purposes.

A more recent example of a circuit breaker including additional accessories is found in U.S. Pat. No. 4,622,444 entitled "Circuit Breaker Housing and Attachment Box" which allows the accessories to be field-installed within the circuit breaker without interfering with the integrity of the circuit breaker internal components. This is accomplished by mounting the accessories within a recess formed in the circuit breaker enclosure cover.

An electronic trip actuator which is mounted within the circuit breaker enclosure is described within U.S. Pat. No. 4,679,019 entitled "Trip Actuator for Molded Case Circuit Breakers". The circuit breaker actuator responds to trip signals generated by an electronic trip unit completely contained within a semi-conductor chip such as that described within U.S. Pat. No. 4,589,052. The development of a combined trip actuator for both overcurrent protection as well as accessory function is found within U.S. Pat. No. 4,700,161 entitled "Combined Trip Unit and Accessory Module for Electronic Trip Circuit Breakers". The aforementioned U.S. patents which represent the advanced state of the art of circuit protection devices are incorporated herein for reference purposes.

A shunt trip accessory unit includes a shunt trip coil which allows the circuit breaker operating mechanism to be articulated to separate the circuit breaker contacts, usually to perform a tripping function for electrical system control and protection. An additional circuit board and switch arrangement are required to disconnect current to the shunt trip coil such that field-installation has heretofore not been easily accomplished. The instant invention provides a shunt trip accessory that includes the disconnect switch and circuit board within a single unit which is field-installable without exposing the circuit breaker components and which requires a minimum amount of additional wiring at the site of installation.

SUMMARY OF THE INVENTION

An integrated protection unit which includes overcurrent protection along with auxiliary accessory function, contains an access cover for the selected accessory components, to allow field installation of the accessory components prior to connecting the integrated protection unit within an electric circuit. One such accessory unit comprises a field-installable shunt trip unit which is installed in the circuit breaker cover and extends downward to the circuit breaker operating mechanism. The shunt trip unit allows the circuit breaker operating mechanism to be articulated from a remote location to perform a tripping function for electrical system control and protection.

DESCRIPTION OF THE PREFERRED EMBODIMENT

Figure 1:
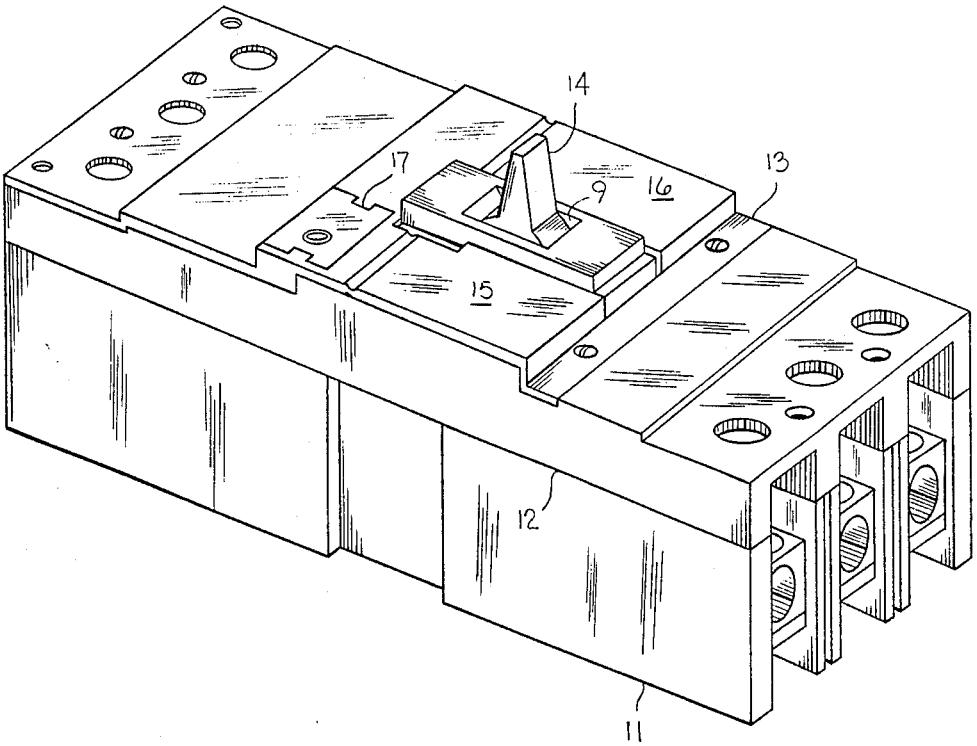
FIG. 1 is a top perspective view of an integrated protection unit containing the shunt trip accessory unit according to the invention.

An integrated circuit breaker 10 consisting of a molded plastic case 11 with a molded plastic cover 12 is shown in FIG. 1 with the accessory cover 13 attached to the circuit breaker cover. The circuit breaker operating handle 14 extends up from an access slot 9 formed in the circuit breaker cover 12.

Figure 2:
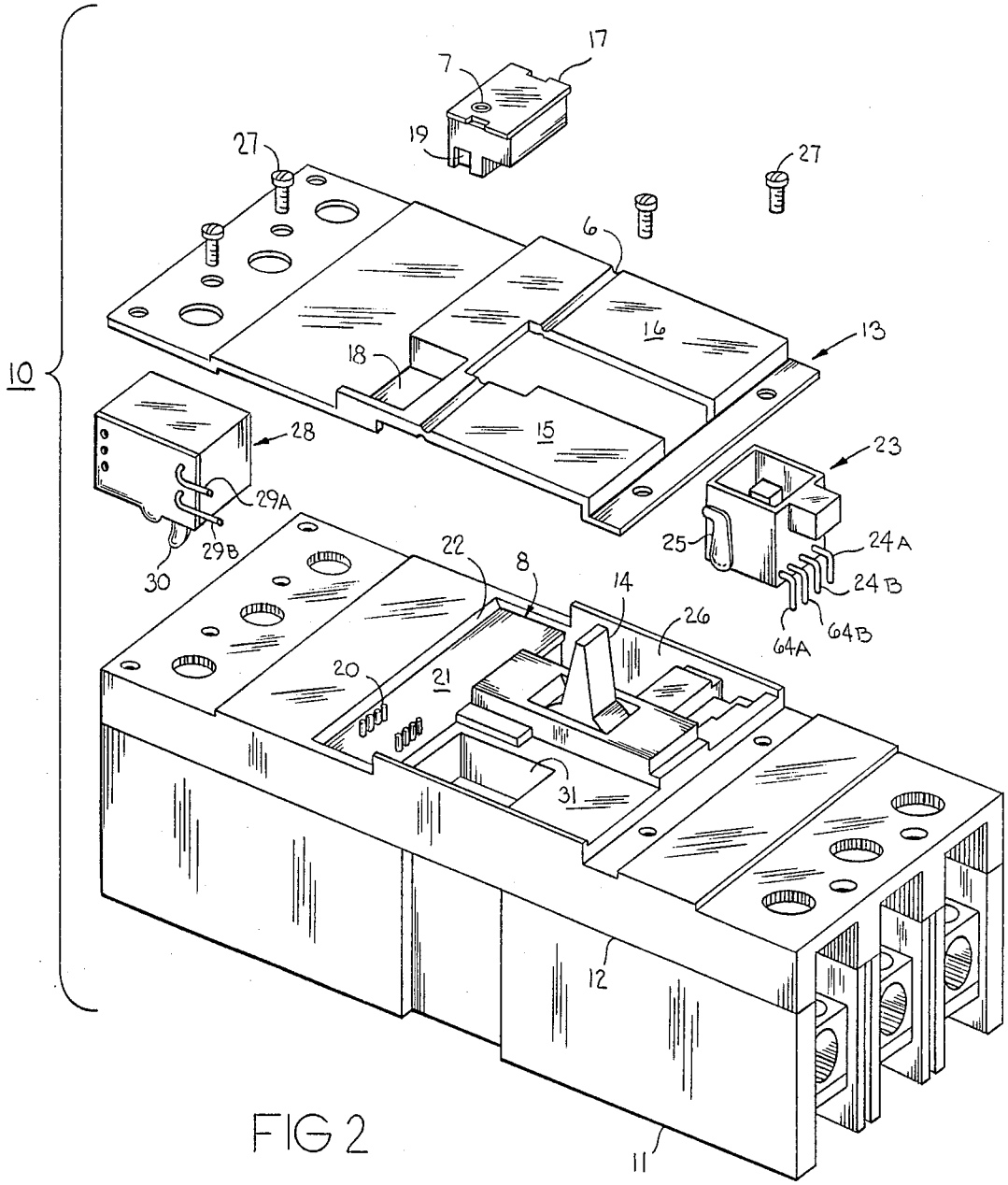
FIG. 2 is an exploded top perspective view of the circuit breaker rating plug, actuator unit and shunt trip unit prior to assembly within the integrated protection unit of FIG. 1.

A pair of accessory doors 15, 16 are formed in the accessory cover for providing access to the electromagnetic actuator 23 and shunt trip unit 28, shown in FIG. 2. The rating plug 17 is fitted within a recess 18 formed in the accessory cover. The accessory cover is fastened to the circuit breaker cover by means of screws 27. Still referring to FIG. 2, the electromagnetic actuator 23, contains a flux shifter coil (not shown) and a shunt trip coil $STC_1$ (FIG. 6) such as described in the aforementioned U.S. Pat. Nos. 4,679,019 and 4,700,161 and is fitted with an actuator lever 25 for interrupting the circuit breaker operating mechanism (not shown). The operating mechanism is similar to that described within U.S. patent application Ser. No. 092,962, filed Sept. 3, 1987 entitled "Molded Case Circuit Breaker Latch and Operating Mechanism Assembly", which Application is incorporated herein for purposes of reference. The electromagnetic actuator 23 within recess 26 connects with an electronic trip unit 8 by means of wire conductors 24A, 24B and with the printed wire board 36 (FIG. 3) contained within the shunt trip unit 28 by means of a pair of wire conductors 64A, 64B. The trip unit 8 is in the form of a printed wire board 21 which is inserted in the printed wire board recess 22 formed in the circuit breaker cover 12 and which connects electrically with the rating plug 17 by means of pins 20 upstanding on the printed wire board and sockets 19 formed in the bottom of the rating plug 17. The rating plug is described in U.S. patent application Ser. No. 045,645, filed May 4, 1987, entitled "Rating Plug Enclosure for Molded Case Case Circuit Breakers", which application is incorporated herein for purposes of reference. Access opening 7 formed on the top of the rating plug 17 allows for verifying the trip characteristics of the electronic trip unit 8. The electronic trip unit electrically connects with a current transformer (not shown) contained within the integrated circuit breaker case 11 and which is described in U.S. Pat. No. 4,591,942, which patent is incorporated herein for purposes of reference. The integrated circuit breaker 10 depicted in FIG. 1 includes three poles, with one current transformer supplied within each separate pole. In accordance with the instant invention, the shunt trip unit 28 is inserted within a shunt trip recess 31 formed in the integrated circuit breaker cover 12 and is positioned such that a depending lever 30 interacts with the circuit breaker operating mechanism in a manner to be described below in greater detail. A pair of wire conductors 29A, 29B electrically connect through a switch or relay to a remote voltage source (not shown) to articulate the circuit breaker operating mechanism in order to separate the circuit breaker contacts (not shown). In the particular arrangement depicted in FIG. 2, access to the actuator 23 is made by means of accessory door 16 which is integrally formed within the accessory cover 13 and access to the shunt trip unit 28 is made by means of accessory door 15. This arrangement differs from those described in concurrently filed U.S. patent application Ser. No. 133,868 entitled "Molded Case Circuit Breaker Auxiliary Switch Unit" and U.S. patent application Ser. No. 133,869 entitled "Molded Case Circuit Breaker Multiple Accessory Unit", which applications are incorporated herein for purposes of reference. The accessory doors 15, 16 are hingably attached to the accessory cover 13 by means of a hinge 6 integrally formed therein. A good description of the accessory cover 13 is found within U.S. patent application Ser. No. 061,244, filed June 12, 1987 and entitled "Molded Case Circuit Breaker Accessory Enclosure", which application is incorporated herein for reference purposes.

Figure 3:
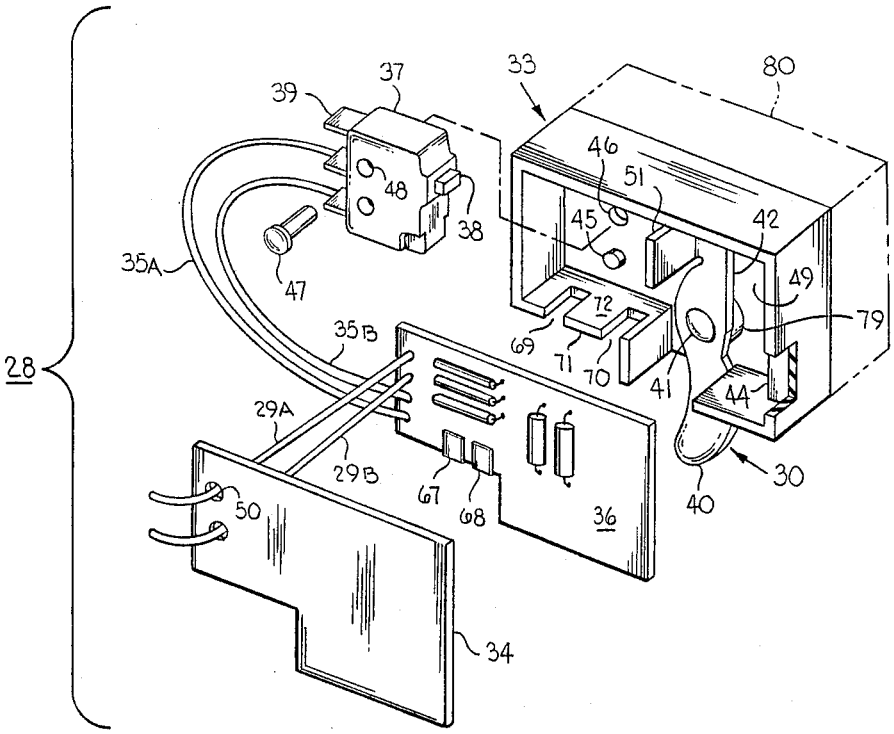
FIG. 3 is a top perspective view of the shunt trip accessory unit of FIG. 2 prior to assembly.
Figure 4:
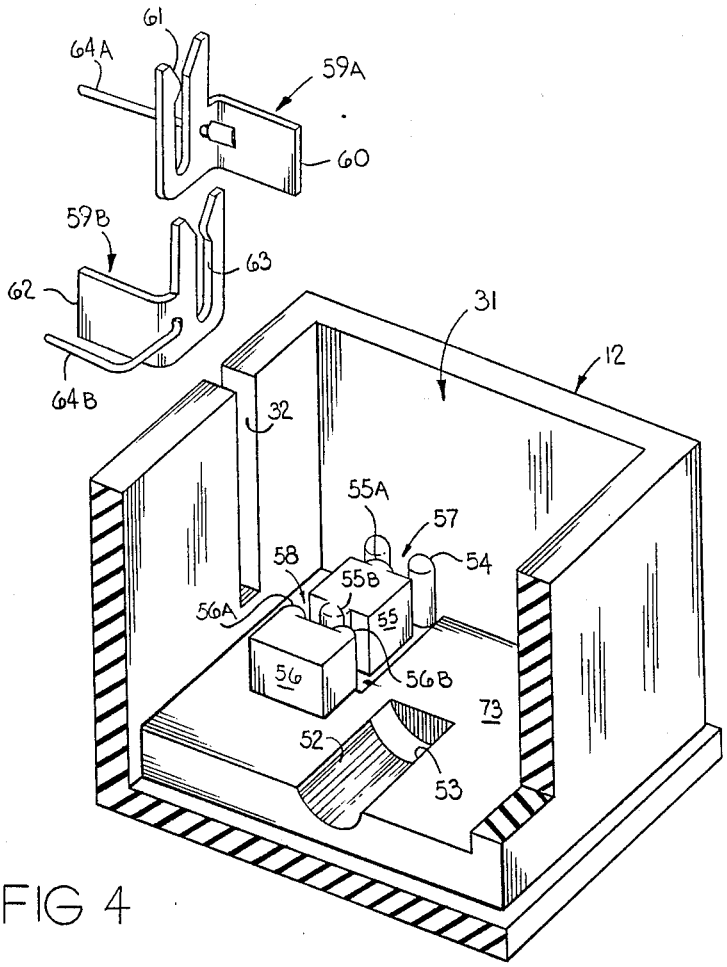
FIG. 4 is a top perspective view of a part of the circuit breaker cover of FIG. 1 prior to insertion of the printed wire board connectors.

The shunt trip unit 28 is assembled in the manner depicted in FIG. 3 wherein a shunt trip case 33 is shown with an operating lever 30 pivotally supported by means of a pivot pin 41, extending through the operating lever and wall 49 and supported within cylinder 79 integrally formed in the bottom 72 of the shunt trip case 33. The bottom arm 40 of the operating lever extends throught a slot (not shown) formed in the bottom 72 of the shunt trip case 33 and interacts with the circuit breaker operating mechanism in a manner to be described below in some detail. A top arm 42 of the operating lever 30 includes an angled tab 51 which acts as a plunger 38 on the electric switch 37 when the electric switch is mounted on the wall 49 of the shunt trip case 33 by capturing the location post 45 integrally formed on the wall 49 within a thru hole 48 formed within the electric switch 37 and inserting a rivet 47 within the other thru hole 48 and then through the hole 46 formed in the wall 49. The electric switch 37 is connected with a printed wire board 36 by means of contact blades 39 and wire conductors 35A, 35B. The printed wire board is positioned within the shunt trip case 33 against a projection 44 integrally formed within the case and is arranged within the case such that a part of the printed wire board extends over a pair of slots 69, 70 formed through an extension 71 of the bottom the shunt trip case 33. A pair of wire conductors 29A, 29B connected to the printed wire board 36 pass through a pair of openings 50 through the cover 34 for electrical connection with a remote control switch or relay as described earlier, with reference to FIG. 2. A pair of edge connector pads 67, 68 formed on either side of the bottom of the printed wire board 36 extend over the slots 69, 70 formed in the extension 71 of the shunt trip case 33 and become captured in a corresponding pair of slots 61, 63 formed within the printed wire board edge connectors 59A, 59B best seen by referring now to both FIG. 3 and FIG. 4.

The bent plates 60, 62 formed on the connectors are press-fitted within slots 57, 58 that are arranged on the bottom 73 of the shunt trip recess formed within the circuit breaker cover 12. Slot 57 is defined between a pair of upstanding posts 54 integrally formed within the bottom of the shunt trip recess and the projection 55A formed on one side of a cruciform block 55 also formed within the bottom of the shunt trip recess. Slot 58 is defined between a radial projection 55B formed on the opposite side of the cruciform block 55 and a pair of radial projections 56A, 56B formed on a rectangular block 56 integrally formed within the hottom 73 of the shunt trip recess 31. With both printed wire board connectors 59A, 59B press-fitted within their respective slots 57, 58, the wire conductors 64A, 64B attached thereto exit from the shunt trip recess through the wire access slot 32 described earlier with reference to FIG. 2. The pair of wires 64A, 64B connect with the shunt trip coil within the electromagnetic actuator 23 of FIG. 2 which shunt trip coil is not shown but is described within the aforementioned U.S. Pat. No. 4,700,161. Still referring to both FIGS. 3 and 4, the cylinder 79 extends below the bottom 72 of the shunt trip case 33 and nests within the semi-cylindrical groove 52 formed in the bottom 73 of the shunt trip recess 31. The bottom arm 40 of the operating lever 30 extends downward through a slot 53 formed through the bottom 73 of the shunt trip recess 31.

Figure 5:
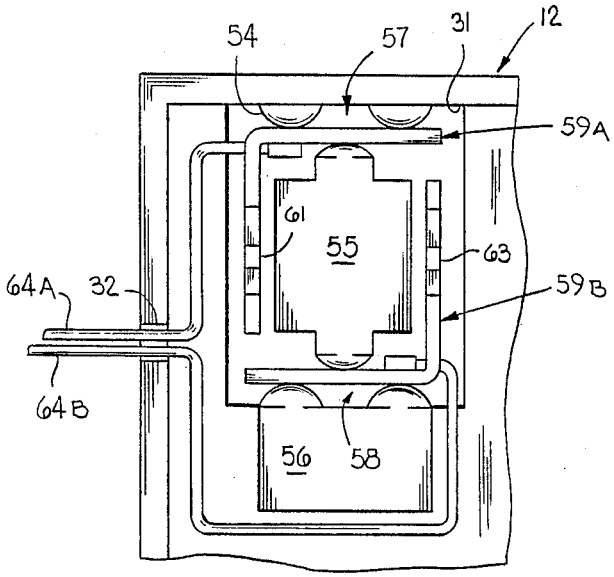
FIG. 5 is a plan view of the circuit breaker cover of FIG. 1 with the printed wire board connectors installed therein.

The printed wire board edge connectors 59A, 59B are shown in FIG. 5 positioned within the respective slots 57, 58 defined between the posts 54 next to the wall of the circuit breaker cover 12 on one side of the cruciform block 55 and between the rectangular block 56 on the other side of the cruciform block 55, as indicated. The slots 61 and 63 formed within the printed wire board edge connectors 59A, 59B thereby become precisely positioned within the shunt trip recess for receiving the edge connector pads 67, 68 on the bottom of the printed wire board 36 (FIG. 3) and electrically connect the printed wire board with the electromagnetic actuator 23 (FIG. 2) by means of the wire conductors 64A, 64B which exit from the shunt trip recess through slot 32.

Figure 6:
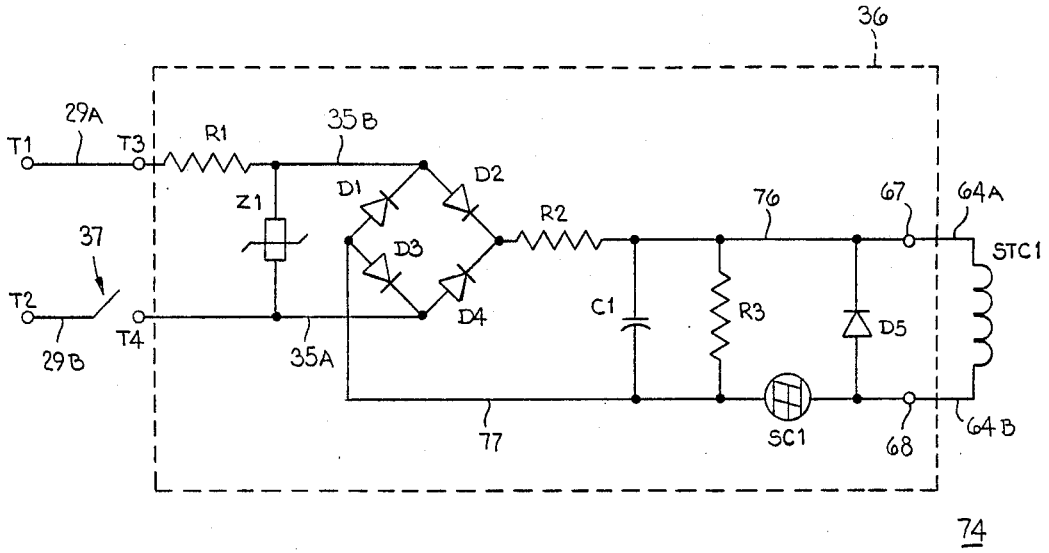
FIG. 6 is a diagrammatic view of the electronic circuit contained within the printed wire board depicted in FIG. 3.

The circuit 74 within the printed wire board 36, shown earlier in FIG. 3 is depicted in FIG. 6 and contains the following components. Terminal 3 connects through a current limiting resistor $R_1$ and conductor 35B to one input of a bridge rectifier consisting of diodes D1–D4 to provide positive potential to a bus conductor 76. Terminal T4 connects through conductor 35A with the other input to the bridge rectifier. A voltage suppressing varistor $Z_1$ is connected across the inputs to the bridge rectifier to protect the circuit 74 from excess voltages. One output of the bridge rectifier connects through resistor $R_2$ with the positive bus 76 which terminates at the printed wire board edge-connector pad 67. The other output of the bridge rectifier connects with the negative hus 77 and through a silicon bilateral switch SC1 to the other edge-connector pad 68. Capacitor $C_1$ is connected across the positive and negative busses 76, 77 and becomes charged by means of a voltage applied across terminals T1, T2 over wire conductors 29A, 29B. When the voltage on the capacitor is greater than the break-over voltage on the bilateral switch, the capacitor discharges through the shunt trip coil $C_1$ to articulate the circuit breaker operating mechanism as described in the aforementioned U.S. Pat. No. 4,700,161 wherein the shunt trip coil $STC_1$ is described as included within the electromagnetic actuator 23 shown in FIG. 2. A resistor R3 bleeds off current from capacitor $C_1$ allowing the circuit breaker operating mechanism to be reset. The electric switch 37 located within the shunt trip unit 28 of FIG. 3 protects the shunt trip coil $STC_1$ from overheating by immediately disconnecting voltage to the printed wire board 74 as soon as the circuit breaker operating mechanism has responded. This is accomplished by the interaction of the bottom arm 40 of the shunt trip operating lever 30 of FIG. 3 and the circuit breaker operating mechanism (not shown). The bottom arm 40 of the shunt trip operating lever 30 holds the top arm 42 and angled tab 51 in contact with the electric switch plunger 38 as long as the bottom arm 40 remains in contact with the circuit breaker operating mechanism. When the shunt trip coil $STC_1$ (FIG. 6) has articulated the circuit breaker operating mechanism, the bottom arm 40 of the operating lever 30 moves away from the electric switch plunger 38 allowing the plunger to extend and interrupt circuit through the switch 37 to immediately interrupt the voltage applied to the printed wire board 74 and hence to the shunt trip coil $STC_1$. The shunt trip coil $STC_1$ is connected with the printed wire board 36 over conductors 64A, 64B and is protected from overvoltage spikes by means of diode $D_5$. When the circuit breaker operating mechanism is turned on the bottom arm 40 moves back into contact with the plunger 38 causing the electric switch 37 to close and restoring charging power to the capacitor $C_1$.

The auxiliary switch accessory unit 80 described within the aforementioned U.S. patent application entitled "Molded Case Circuit Breaker Auxiliary Switch" is shown in phantom attached to the shunt trip case 33 in FIG. 3. When the auxiliary switch accessory unit is so attached, the same operating lever 30 serves to operate both the electric switch 37 contained within the shunt trip 28 as well as the electric switch contained within the auxiliary switch accessory unit 80.

Having thus described our invention, what we claim as new and desire to secure by Letters Patent is:

1. A molded case circuit breaker and shunt trip unit comprising:

a circuit breaker case and cover;

an operating mechanism within said case and arranged for separating a pair of contacts connecting between line and load terminals arranged on said case;

an accessory cover mounted on said circuit breaker cover;

a shunt trip coil within a recess in said circuit breaker cover and arranged for interacting with said operating mechanism to separate said contacts upon receipt of an electric signal;

an electric switch and circuit within an enclosure contained in a separate recess within said circuit breaker cover and accessible through said accessory cover;

an operating lever within said enclosure and extending within said circuit breaker case, said operating lever being arranged against a plunger on said switch when said contacts are closed and being away from said switch when said contacts are open, said electric signal being transmitted to said coil when said operating lever is against said plunger and said electric signal being interrupted to said coil when said lever is away from plunger.

2. The molded case circuit breaker and shunt trip unit of claim 1 including first wire conductors connecting between said switch and said circuit and second wire conductors connecting between said coil and said circuit.

3. The molded case circuit breaker and shunt trip unit of claim 2 including a slot formed through a bottom of said enclosure.

4. The molded case circuit breaker and shunt trip unit of claim 3 wherein said circuit is arranged on a printed wire board and wherein said printed wire board includes an edge-connector pad.

5. The molded case circuit breaker and shunt trip unit of claim 2 wherein said first pair of wires exits said enclosure through an opening through a cover on said enclosure.

6. The molded case circuit breaker and shunt trip unit of claim 1 wherein said switch is electrically in series with said coil.

7. The molded case circuit breaker and shunt trip unit of claim 1 wherein said operating lever is pivotally attached to said enclosure.

8. The molded case circuit breaker and shunt trip unit of claim 1 further including a silicon bilateral switch in series with said coil.

9. The molded case circuit breaker and shunt trip unit of claim 1 further including means connecting said enclosure with an external circuit.

10. The molded case circuit breaker and shunt trip unit of claim 9 wherein said connecting means comprises third pair wire conductors exiting said circuit breaker case through a slot formed along an exterior surface thereof.

11. The molded case circuit breaker and shunt trip unit of claim 4 including an angled connector fitted within said circuit breaker case having means thereon for capturing said edge-connector pad, said angled connector being attached.

12. The molded case circuit breaker and shunt trip unit of claim 11 including fourth wire conductors connecting between said angled connector at one end and said shunt trip coil at an opposite end.

13. The molded case circuit breaker and shunt trip of claim 11 wherein said angled connector is press-fitted within projections integrally formed within a bottom of said circuit breaker case.

14. The molded case circuit breaker and shunt trip of claim 11 wherein said connection means comprise a tapered slot formed within said angled conductor.

15. The molded case circuit breaker and shunt trip of claim 4 wherein said edge-connector pad aligns with said slot.

* * * * *